US006286583B1

(12) United States Patent
Rueckert et al.

(10) Patent No.: US 6,286,583 B1
(45) Date of Patent: Sep. 11, 2001

(54) TWO PART LIGHT METAL COATING AND METHOD OF MAKING SAME

(75) Inventors: Franz Rueckert, Ostfildern; Peter Stocker, Sulzbach, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/551,882

(22) Filed: Apr. 18, 2000

Related U.S. Application Data

(62) Division of application No. 08/917,967, filed on Aug. 27, 1997, now Pat. No. 6,074,763.

(30) Foreign Application Priority Data

Aug. 27, 1996 (DE) ..... 196 34 504

(51) Int. Cl.[7] ..... B22D 19/00
(52) U.S. Cl. ..... 164/100; 164/91
(58) Field of Search ..... 164/100, 91, 94

(56) References Cited

U.S. PATENT DOCUMENTS

| | | | | |
|---|---|---|---|---|
| 4,023,613 | * | 5/1977 | Uebayasi et al. | 164/100 |
| 4,154,900 | * | 5/1979 | Kalu et al. | 428/554 |
| 5,333,668 | * | 8/1994 | Jorstad et al. | 164/100 |
| 5,429,173 | * | 7/1995 | Wang et al. | 164/100 |
| 5,537,969 | | 7/1996 | Hata et al. . | |
| 5,820,938 | * | 10/1998 | Pank et al. | 427/449 |
| 5,891,273 | * | 4/1999 | Ruckert et al. | 148/523 |

FOREIGN PATENT DOCUMENTS

| | | | | |
|---|---|---|---|---|
| 656 809 | | 2/1938 | (DE) . | |
| 1 458 095 | | 9/1969 | (DE) . | |
| 38 36 585 A1 | | 5/1989 | (DE) . | |
| 3836585 | * | 5/1989 | (DE) | 164/100 |
| 43 03 339 A1 | | 8/1994 | (DE) . | |
| 43 28 619 C2 | | 8/1995 | (DE) . | |
| 44 38 550 A1 | | 5/1996 | (DE) . | |
| 0 424 109 A2 | | 4/1991 | (EP) . | |
| 0 463 314 A1 | | 1/1992 | (EP) . | |
| 0 532 331 A1 | | 3/1993 | (EP) . | |
| 869 081 | | 3/1961 | (GB) . | |
| 881 258 | | 11/1961 | (GB) . | |
| 120 467/1980 | | 3/1979 | (JP) . | |
| 59-54754 | * | 3/1984 | (JP) | 164/100 |
| 238 157/1991 | | 2/1990 | (JP) . | |
| 293 360/1992 | | 6/1990 | (JP) . | |
| 69 107/1993 | | 2/1991 | (JP) . | |
| 306 352/1994 | | 4/1993 | (JP) . | |
| 155 836/1996 | | 6/1996 | (JP) . | |
| 267 634/1997 | | 5/1999 | (JP) . | |
| 95/29024 | | 11/1995 | (WO) . | |

* cited by examiner

*Primary Examiner*—Kuang Y Lin
*Assistant Examiner*—I.-H. Lin
(74) *Attorney, Agent, or Firm*—Crowell & Moring, L.L.P.

(57) ABSTRACT

A cylinder-liner blank which preferably consists of a hypereutectic aluminum/silicon alloy and is cast into a crankcase. A special surface treatment achieves better material bonding of the liner in the crankcase. The blank has a roughness of 30 to 60 $\mu$m on its outside, in the form of pyramid-like or lancet-like protruding material scabs or material accumulations. To obtain this roughness, the surface is blasted with particles which are broken so as to have sharp edges and consist of a brittle hard material, preferably high-grade corundum, with an average grain size of about 70 $\mu$m. A fine fraction is formed and is continuously separated off. The average grain size is maintained by adding new particles.

4 Claims, 6 Drawing Sheets

TWO PART LIGHT METAL COATING AND METHOD OF MAKING SAME

This application is a division of application Ser. No. 08/917,967, filed Aug. 27, 1997 and now issued as U.S. Pat. No. 6,074,763.

BACKGROUND AND SUMMARY OF THE INVENTION

This application claims the priority of German patent application No. 196 34 504.9, the disclosure of which is expressly incorporated by reference herein.

The present invention relates to a light-metal-part blank which is to be cast into another light-metal casting, and has a roughness of more than 20 $\mu$m on its outer surface, and also to a method for producing the blank in which method the surface of a blank is blasted with a directed jet of particles which consist of a hard material and are carried along in a flowing gas.

DE 44 38 550 A1 describes the casting of a cylinder liner into a crankcase. Casting separately manufactured cylinder liners into light-metal crankcases has successfully optimized the running properties of the reciprocating piston in the cylinder liner, irrespective of the material of the crankcase. Problems with casting the cylinder liners into the light-metal crankcase arise, however, due to the inadequacy of the bonding of the outside of the liner with the crankcase material. When the engine is running, materially imperfect bonding can cause the emission of waste heat from the reciprocating-piston engine to be impeded. In particularly unfavorable instances, this emission can even lead to a loosening of the cylinder liner in the crankcase. As regards other parts to be cast in, for example forged rotor recesses in a cast piston, good bonding is indispensable, for strength reasons alone.

DE 43 28 619 C2 discusses problems involved in good material bonding of the light-metal components during casting in, in particular in the instance of a cylinder liner to be cast in. An objective is a pore-free material union between the outside of the liner and the case material by controlled preheating of the cylinder liner. The cylinder-liner blank preheated to a specific temperature, for example 450° C., and introduced into the casting mold has its surface melted (incipiently) by the inflowing melt of the case material, and an intimate bond with the case material is thereby made. A high melt flow directed parallel to the contact surface further assists this effect, not only by bringing about increased incipient melting as a result of a better heat exchange, but also by washing off the oxide skin, which is always present, from the contact side of the liner.

Such an intensive relative flow of the melt can be ensured by various measures. The above-mentioned publication mentions, for example, a choice and distribution of the gates, an agitation of the melt or even an induction of electrical eddy currents which cause fluid flows in the melt. A disadvantage of this method, however, is that the liner blanks preheated to temperatures which bring about reliable incipient melting are difficult to handle, especially during the casting of multi-cylinder crankcases. With the gradual introduction of the individual preheated liners into the casting die, either different liner temperatures have to be allowed for, due to cooling, during the casting operation or heating elements have to be provided in the casting die so that the liner blanks already introduced are kept hot, thus making the casting die more complicated and adversely affecting the dissipation of heat from the solidifying cast workpiece.

In any event, a preheating furnace must be installed, and this installation incurs further investment costs, above all, regular power-supply costs. Moreover, the high preheating temperatures may lead to undesirable structural changes in the material of the cylinder liner which can adversely influence the liner's running properties. Tribologically relevant structural changes are obtained if the liner blank, while being cast in, is melted down nearly into the region of the running surface.

A machining oversize of at least about 1 mm provided on the inside of the liner blank must be taken into account. In order, therefore, to prevent the liner blank from actually melting through at all locations, a correspondingly thick-walled blank has to be provided. For reasons of the smallest possible cylinder spacing, however, the cylinder liner should be as thin-walled as possible. If, for whatever reason, the liner is not sufficiently preheated, i.e. by way of precaution or through carelessness, then, at least in die casting, only very short periods of time are available for filling the mold and until solidification commences. Consequently, the aforementioned incipient-melting measures cannot take effect, or can take effect only very incompletely, in the short time periods available.

An object of the present invention is to improve the blank of a light-metal structural part to be cast in, and the corresponding production method. Thereby, the blanks, while being cast in, make an intimate material union over a wide area with the cast material of the cast-round part, even without preheating.

This and other objects have been achieved, according to the present invention, by providing a light-metal-part blank which is to be cast into another light-metal casting and has a roughness of more than 20 $\mu$m on its outer surface, which is to be surrounded by the material of the light-metal casting, the topography of this surface being formed by tapering, approximately pyramid-like or lancet-like protruding material scabs or material accumulations, which merge directly at their base into the basic structure of the blank.

Likewise, the improved method achieves the aforementioned object by in which method first of all a blank is produced and machined to the desired shape and desired size and, subsequently, the outer surface of the blank, which surface is to be surrounded by the material of the casting, is blasted with a directed jet of particles which consist of a hard material and are carried along in a flowing gas.

It is important that the outer contact surface of the blank has a topography with a multiplicity of tapering material elevations, for example of pyramid-like or lancet-like form, which merge, undisturbed, at their base, over a wide area, into the basic material of the blank. Notwithstanding the existing oxide skin, the tips of the multiplicity of small pyramid-like or lancet-like protruding material scabs or material accumulations on the contact side of the blank immediately begin to melt, in their tip region when they come into contact with the melt of the cast-round part. This results from the small contact zone having sufficiently high heat energy supplied by contact with the melt, with heat dissipation into the depth of the material being initially still low. Thus, a sufficient energy density is locally available in order to overcome the barrier of the oxide skin locally.

The incipient melting which has been initiated spreads very quickly in the near-surface layer on the contact side of the blank. The pyramid-like or lancet-like protruding material scabs or material accumulations thus constitute initiating locations for the incipient-melting operation. Because of the rapid progress of an incipient-melting operation once begun and of dense covering of the contact side by such initiating locations, the locations where incipient melting has begun very quickly coalesce into a continuous near-surface incipient-melting zone. The incipient melting therefore spreads quickly over the surface area, but penetrates only relatively little into the depth of the blank wall. Thereby, the structure remains unaffected on the opposite side of the wall of the blank, for example on the piston running side.

The following are among the numerous and widely differing advantages can be achieved with the present invention;

preheating of the cast-in part, in particular the liner blank to be cast in, is eliminated along with the associated investment and operating costs and handling problems;

roughening the outer or contact surface of the cast-in part also achieves the effect of cleaning, which is necessary in any case, so that separate cleaning is unnecessary; the outlay in terms of investment costs and regular costs for roughening is approximately comparable to that for cleaning, so that roughening requires virtually no extra outlay;

in the case of liner blanks to be cast in, tribologically relevant structural changes on the running side of the liner blank can be avoided with a high degree of process reliability;

allowing the cast-in part to have smaller wall thicknesses; at the very least, smaller wall thicknesses can be controlled with greater process reliability than in a casting-in operation with preheating of the casting;

providing smaller cylinder wall thicknesses to allow smaller cylinder spacings and therefore, with the piston capacity remaining the same, shorter, lighter and more cost-effective engines; this, in turn allows smaller engine spaces in the motor vehicle and, due to the mass involved, lower fuel consumption for the motor vehicle driven thereby;

in comparison with the casting in of non-roughened cast-in parts, achieving a better metallurgical bond which is largely of uniformly high quality over the extent of the contact surface between the cast-in part and the cast-round part;

as a result, where cylinder liners are concerned, as measurements have shown, higher manufacturing accuracy, in particular less manufacturing related cylinder warping, can be achieved, because a cylinder liner which has good bonding to the crankcase allows the crankcase to be more rigid than a liner essentially only positively surrounded;

due to the better metallurgical bonding of the liner to the crankcase material, a higher rigidity is achieved along with a cylinder wall which is uniform in the circumferential and axial directions (i.e. homogeneous), and., when the cylinder head is being assembled, with a gasket interposed, less assembly-related cylinder warping;

by virtue of the high-strength material bonding of the cylinder liner in the crankcase, there is no need for retaining collars on the end faces of the liner; the liner is thereby configured particularly simply from a manufacturing point of view and can thus be produced cost-effectively;

as regards cylinder liners, due to the better metallurgical bonding of the liner to the case material, better heat transmission which is more uniform over the surface area, a more uniform temperature profile of the cylinder liner in the circumferential and axial directions and less thermally related cylinder warping can be achieved when the engine is running;

moreover, the temperature level of the well bonded-in cylinder liner as a whole is lower than in cylinder liners which are cast in without being roughened; this has a favorable effect on the oil evaporation rate when the engine is running and therefore on the oil consumption and on the exhaust gas content of hydrocarbons produced by the lubricating oil;

higher manufacturing-related dimensional accuracy, less assembly-related cylinder warping and less operation-related thermal warping of the cylinder liners, in turn, achieve a smaller piston clearance which has a favorable effect on the exhaust gas content of hydrocarbons produced by the fuel;

the high dimensional accuracy of the running surface reduces piston vibration and thus results in smoother engine operation; and the high dimensional accuracy of the running surface also results in a better sealing effect of the piston rings and therefore lower blow-through losses and a lower oil consumption (i.e., higher efficiency), lower fuel consumption and lower emissions, particularly of oil-produced hydrocarbons.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
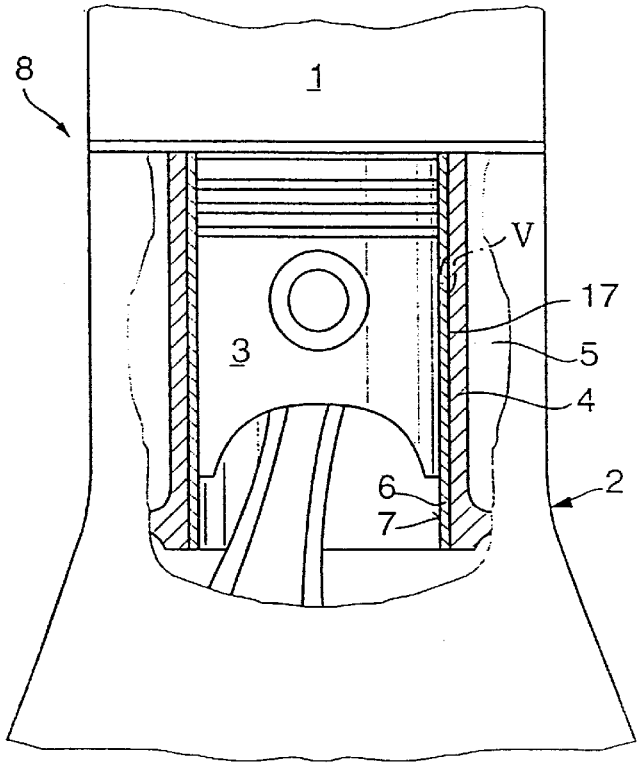
FIG. 1 is a partial sectional view of a reciprocating-piston engine with a cylinder liner cast therein.
Figure 2:
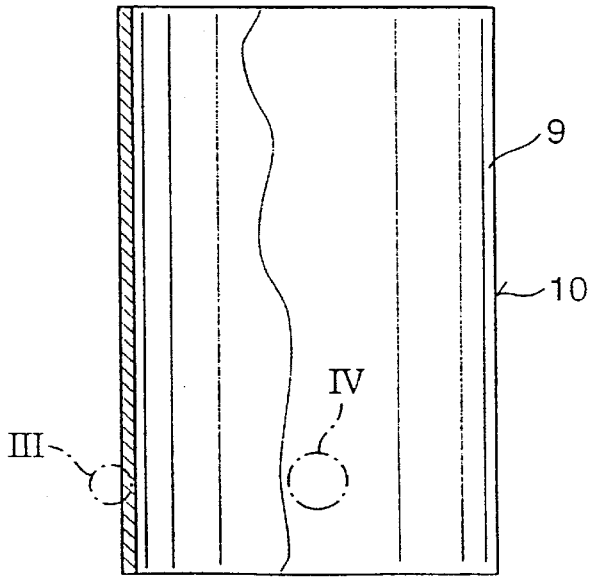
FIG. 2 is a detail of the blank of the cylinder liner for the reciprocating-piston engine shown in FIG. 1.
Figure 3:
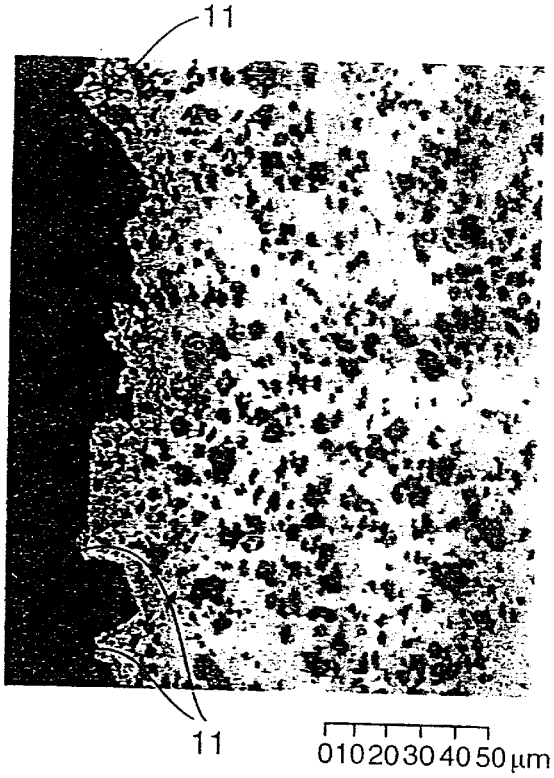
FIG. 3 is a metallographic cross-section through the blank wall at a near-surface region III in FIG. 2 showing the nature of the roughness of the outer surface.
Figure 4:
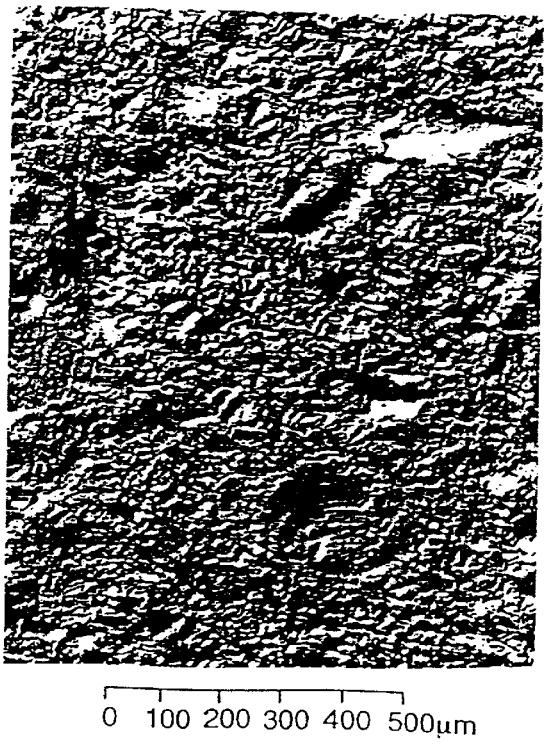
FIG. 4 is a scanning electron microscope photograph of an outer surface detail IV in FIG. 2 showing the topography of the surface.

The portion of the reciprocating-piston engine in FIG. 1 contains a die-cast crankcase 2, in which cylinder jackets 4 which are free-standing at the top (of so-called open-deck configuration) are arranged. Each jacket 4 receives a cylinder liner 6, in which a piston 3 is guided so as to be movable up and down. A cylinder head 1 having the devices for charge exchange and charge ignition is mounted at the top of the crankcase 2, with a cylinder-head gasket being interposed. A cavity for forming a water jacket 5 for cylinder cooling is provided around the cylinder jacket 4, inside the crankcase.

The cylinder liner 6 is produced beforehand as an individual part from a preferably hypereutectic aluminum/silicon alloy, and is then cast as a blank into the crankcase 2 and finish-machined together with the crankcase. When the cylinder liner is cast into the crankcase, a good, undisturbed material bond must be made between the liner material and the case material over as large a proportion of the surface area as possible. For this purpose, the blank 9 has, on its outer surface 10, which is to be surrounded by the material 16 of the light-metal crankcase 2, a specific minimum roughness of 20 $\mu$m, preferably of 30 to 60 $\mu$m. The topography of this surface is formed by tapering, approximately pyramid-like or lancet-like protruding material scabs or material accumulations 11.

The outwardly tapering material elevations 11 are of random shape and size and distributed approximately uniformly over the surface 10. These elevations merge, undisturbed, at their base, over a wide area, into the basic material of the cylinder liner. When the melt of the case material meets the outer surface 10 of the cylinder liner, notwithstanding an oxide skin, the tips of the multiplicity of small material elevations begin to melt immediately, because, on this small contact zone, the heat energy supplied by contact with the melt is sufficiently high and the dissipation of heat into the depth of the material is initially still low. Consequently, a sufficient energy density is locally available in order to be capable of overcoming the barrier of the oxide skin locally. The incipient melting which has been initiated spreads very quickly in the near-surface layer on the contact side of the lines blank.

Because of the rapid progress of an incipient-melting operation once begun and the contact side being densely covered by such initiating locations, the locations where incipient melting has begun very quickly coalesce into a continuous near surface incipient-melting zone. The incipient melting therefore spreads quickly over the surface area, but penetrates only relatively little into the depth of the liner wall. Thereby, the structure remains unaffected near the piston running side of the liner, a machining oversize of at least 1 mm having to be taken into account here too.

During the casting-in operation, despite a low temperature level of the cylinder liners introduced into the casting die, a good material bond is made over a wide area between the cylinder liner and the crankcase. By virtue of the low temperature level, e.g. room temperature, the cylinder liners can be handled and stored without difficulty. Good bonding during casting-in even occurs when the cylinder liners introduced into the casting die are indirectly cooled via the die-side centering mandrel, onto which they are slipped in a specific position. This cooling, e.g. a flow of water through the centering mandrel, reduces not only the cooling times of the casting and therefore increases productivity, but also prevents the liner structure from being heated well below the melting temperature, this heating sometimes bringing about a structure change.

The quality of the good material bond which can be achieved will be explained in more detail below with reference to FIGS. 5 to 9. The series of FIGS. 5, 6 and 7 shows three fundamentally distinguishable bond qualities in a metallographic cross-section taken from the contact zone 17 between a cast-in cylinder liner and the basic case material (detail V according to FIG. 1).

Figure 5:
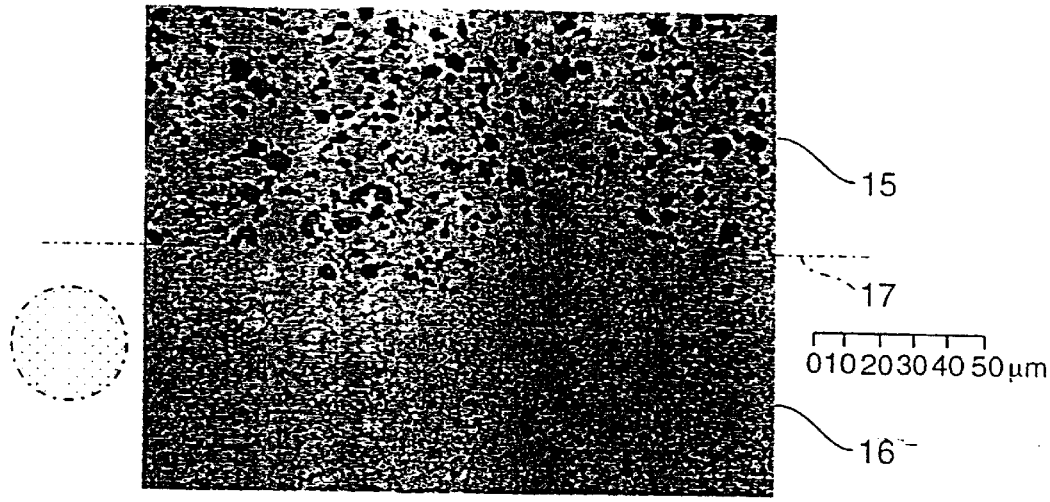
FIG. 5 is a metallographic cross-section through the cylinder wall of the crankcase in region V of FIG. 1 in the boundary region between the cast-in cylinder liner and the basic case material at a location where there is good material bonding between the cylinder liner and the basic case material.

FIG. 5 shows, in a very high magnification indicated by an extended scale, good material bonding between the cylinder liner and the basic case material. The bonding is indicated by cross hatching in the illustrations of FIGS. 8*a* to 8*f* and 9*a* to 9*h*. FIG. 5 clearly reveals the undisturbed transition of the material 15 of the cylinder liner into the material 16 of the crankcase at the former contact zone 17.

Figure 6:
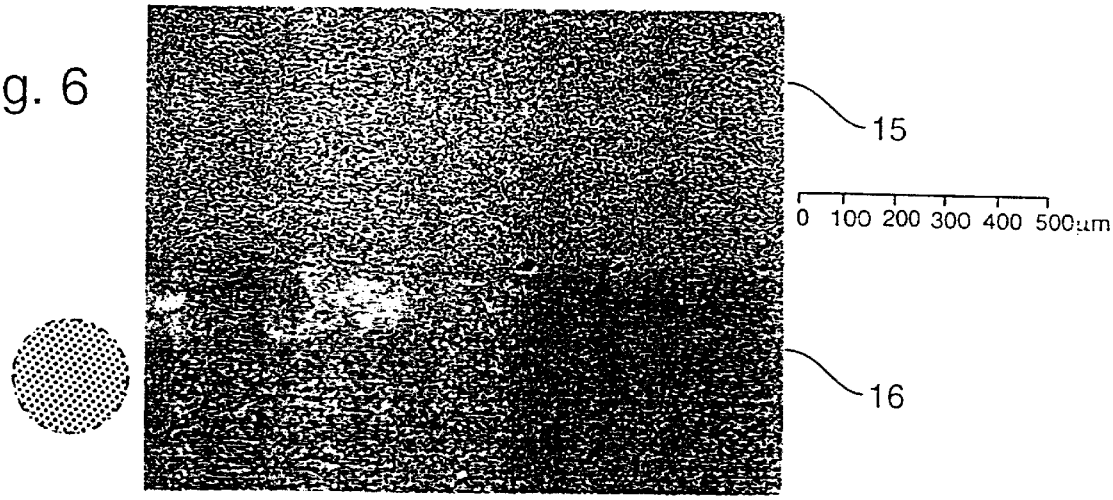
FIG. 6 is a metallographic cross-section similar to that of FIG. 5, but with a magnification lower by a factor of 10 than that of FIG. 5 and at a location where there is a porous bond between the cylinder liner and the basic case material.

FIG. 6 shows a metallographic cross-section similar to that of FIG. 5, but with a magnification greater a factor of 10, as can be seen from the scale indicated, at a location where there is a porous bond between the cylinder liner and the basic case material. The extent of which bond is illustrated by the dots in FIGS. 8*a* to 8*f* and 9*a* to 9*h*. Here, small locations where there is good bonding alternate with more extensive regions of a front-like contrast between the different materials. Air inclusions are also incorporated in these regions.

Figure 7:
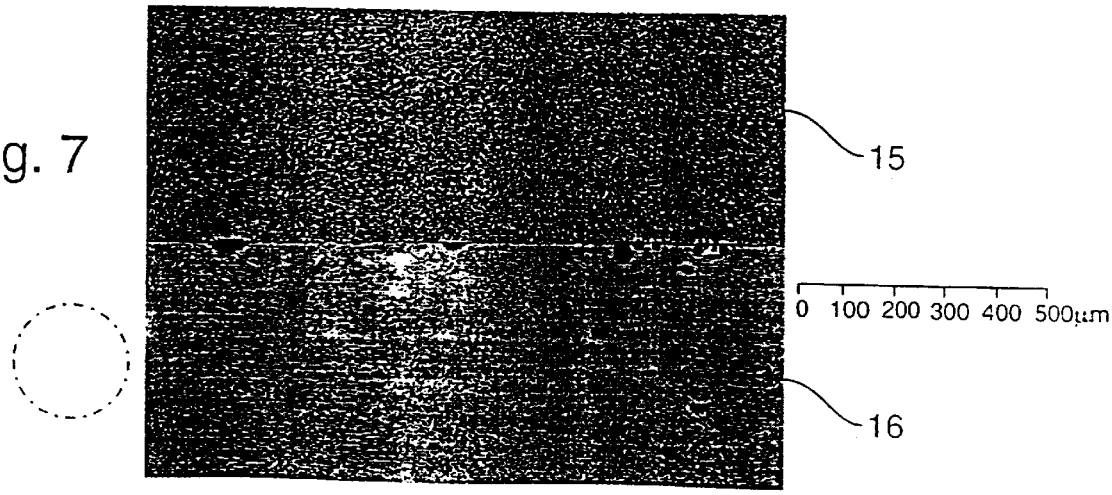
FIG. 7 is a metallographic cross-section similar to that of FIG. 6, also in terms of magnification, but at a location without any bonding between the cylinder line and the basic case material.
Figure 8:
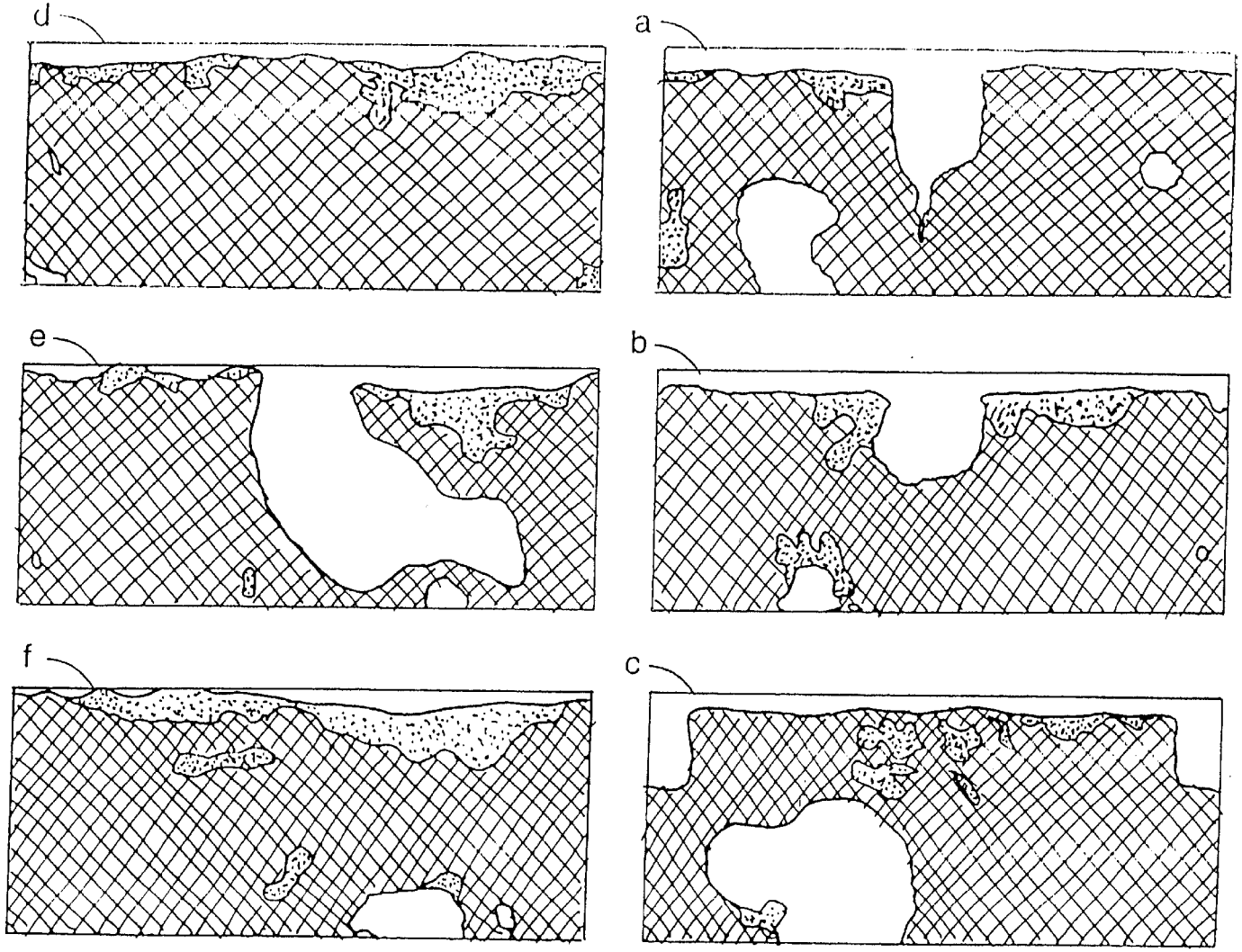
FIGS. 8*a* to 8*f* are a series of ultrasonic reflectance views of the running surfaces of cast-in cylinder liners of a six-cylinder crankcase which were roughened on the outside, in accordance with the present invention, before being cast in, showing the distribution of the bonding between the cylinder liner and the basic case material over the laid-out generated surface of the cylinder liner, in which the cross-hatched region, which represents good material bonding, taking up a proportionally larger surface area.
Figure 9:
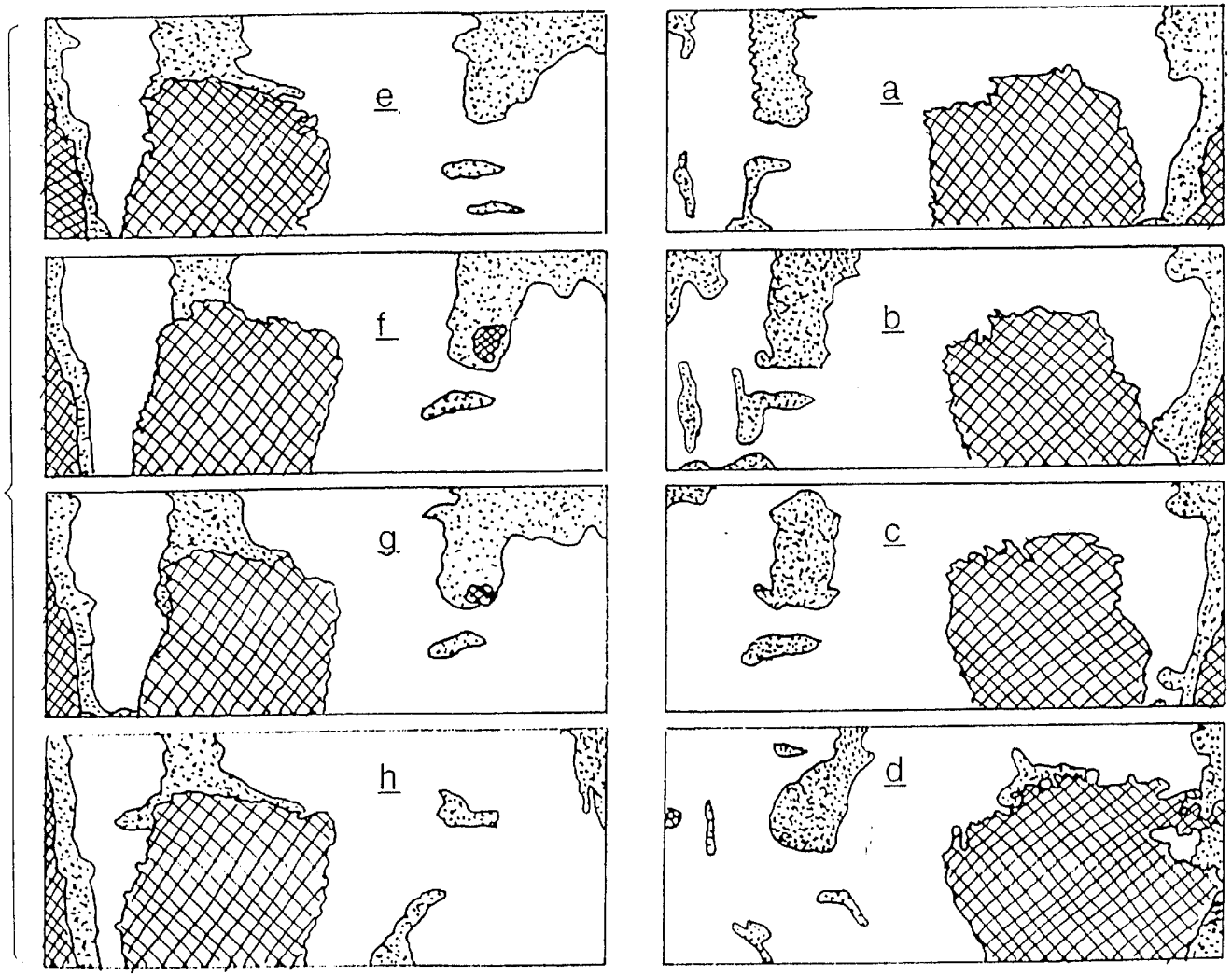
FIGS. 9*a* to 9*h* are a series of comparison ultrasonic reflectance views similar to FIGS. 8*a* to 8*f* of a crankcase which is of basically the same configuration, but which has eight cylinders, in which the liner blanks were lathe-turned with cutting on the outside in a conventional way, the cross-hatched region, having good bonding, taking up a proportionally smaller surface area.

In the metallographic cross-section according to FIG. 7, shown with the same magnification as FIG. 6, a location without any bonding between the cylinder liner and basic case material can be seen. Such regions are illustrated white in FIGS. 8*a* to 8*f* and 9*a* to 9*h*. A small gap with a width of at least 1 $\mu$m and a plurality of air inclusions can be seen here at the contact zone 17.

FIGS. 8*a* to 8*f*, on one hand, and FIGS. 9*a* to 9*h*, on the other hand, show ultrasonic reflectance photographs of the running surfaces of cast-in cylinder liners of a 6-cylinder crankcase and 8-cylinder crankcase, respectively. The cylinder liners are treated differently on the outside before being cast in, FIGS. 8*a* and 9*a* are assigned to the first cylinder, 8*b* and 9*b* to the second cylinder, etc., and FIG. 8*f* being assigned to the sixth, and FIG. 9*h* to the eighth, cylinder of the crankcase. Both are a V-shaped engine arrangement of the banks of cylinders. Therefore the reflectance photographs of the individual cylinders are arranged in two rows.

The long sides of the rectangles in FIGS. 8*a* to 8*f* and 9*a* to 9*h* correspond respectively to the upper and the lower end of the cylinder running surface. The short sides correspond to the generatrix of the running surfaces which is directed towards the front side or control housing side of the internal combustion engine. The vertical center line of the rectangular generated surface is directed towards the rear side of the engine, where the transmission is arranged. The vertical one-quarter dividing lines and the three-quarter dividing lines of the photographs lies at the sides of the rows of cylinders. Specifically, the above-mentioned dividing lines of the reflectance photographs which are directed towards the middle of FIGS. 8*a* to 8*f* and 9*a* to 9*h* correspond to the generatrices directed towards the middle of the V-engine, i.e. to those on the inlet side, whereas the dividing lines directed towards the edge of those figures correspond to the outer generatrices on the outlet side.

Such ultrasonic reflectance photographs are taken under water which serves as a propagation and contact medium between, on one hand, the ultrasonic source or ultrasonic receiver and, on the one hand, the object to be examined. The water and the wall material constitute, so to speak, a more or less homogeneous propagation medium for the ultrasound. The propagation medium is disturbed by defects in the metal, for example gaps lying transversely to the propagation direction or contact locations where there is no material union. Only a small fraction of the ultrasound can bridge defects of this kind, whereas the majority of the primary sound energy is reflected at such defects. An ultrasonic transmitter, which at the same time is an ultrasonic receiver, is arranged at a specific height, and with specific orientation, centrally in the middle of the cylinder liner to be tested. The ultrasonic transmitter emits a very short ultrasonic signal in a highly directional manner and the ultrasonic receiver receives the echo reflected from the cylinder wall. The intensity of the echo, rather than the transit time, is recorded.

As a result of the foregoing type of ultrasonic examination, non-metallic inclusions within the object to be examined are detected by an increase in the intensity of the reflected sound, similar to the manner in which dust particles, smoke or the like can be made visible in a gas by a beam of bright light. At locations where there is fault-free, good material bonding between the cast-in cylinder liner and the crankcase, as in FIG. 5, the emitted ultrasonic pulse passes through the fault-free wall virtually without any echo; i.e., the intensity of the echo is very low here.

At locations disturbed by air inclusions and small gaps, as in FIG. 6; the intensity of the reflected ultrasound is very much higher, whereas, in the case of gaps extended over a wide area; per FIG. 7, a very high proportion of the emitted ultrasound is reflected. Such a test arrangement scans the entire surface of a cylinder liner line by line with high local resolution. This results in ultrasonic reflectance photographs over the laid-out generated surface of the cylinder liner, as can be seen in FIGS. 8*a* to 8*f* and 9*a* to 9*h*.

The ultrasonic reflectance photographs according to FIGS. 8*a* to 8*f* demonstrate good bonding between the cylinder liner and the basic case material. These cylinder liners were roughened, in accordance with the present invention, on their outside 10 before being cast in. The cross-hatched region, which represents good material bonding, takes up proportionally a large surface area, about 80 to 95%, here. Only a few cylinders have zones located on the transmission side or inlet side which contain locations with poor bonding, and these relatively small locations are of tolerable size. Importantly, no location on the circumference of the cylinder liner is entirely without material bonding to the case material. If the region of material bonding is only short in the axial direction, this is restricted to the region of a single, locally small location on the circumference of a few cylinders. Moreover, these images are not reproduced either as regards the individual cylinders of one crankcase or as regards crankcases cast in succession. Further improvements can be achieved by known optimizing measures, particularly as regards the melt guidance.

In the region of the upper edge of the individual reflectance views of FIGS. 8*a* to 8*f*, there is a narrow strip without any material bonding. This is not surprising, because the casting-round operation is carried out from the bottom upwards, in accordance with the casting position and the guidance of the melt, and the upper region is the last to be reached by the melt. Because this poorly bonded region is located in the region of the so-called top land of the piston above the piston rings, however, a higher cylinder-wall temperature is plainly desirable in this region, for reasons of low pollutant emission, and any assembly-related cylinder warping is absolutely negligible.

By contrast, for comparison, the ultrasonic reflectance photographs according to FIGS. 9*a* to 9*h*, taken in the instance of a crankcase of basically similar configuration, but with eight cylinders, show how comparatively poor the bonding result is when the liner blanks are lathe-turned with cutting on the outside in a conventional way. Although the distributions of good and poor bonding of the parts to be cast together are reproduced relatively uniformly here, the results are nevertheless very poor.

Specifically, the reflectance photographs of FIGS. 9*a* to 9*f* show that the cross-hatched region, having good bonding, takes up proportionally only a very small surface area—about 20%. The locations where there is good bonding are all located on the outlet side in the crankcase in accordance with the melt guidance. The proportion without bonding or with disturbed bonding is very high. Under certain circumstances, at least under specific load and/or ambient conditions, this high proportion would impair proper dissipation of the waste operating heat from the internal combustion engine into the cooling water. Furthermore, the result, both in the circumferential axial directions, would be an unequal temperature distribution in the cylinder liner and therefore highly irregular thermal deformation of the liner. This would necessitate a greater piston clearance, which, in turn, would result in a higher proportion of unburnt hydrocarbons in the exhaust gas on account of the larger volume of gap between the piston circumference and cylinder running surface.

Moreover, the imperfectly cast-in cylinder liners according to FIGS. 9*a* to 9*h* suffers from the disadvantage that, over large circumferential regions, they are not connected axially to the case material. At these locations, therefore, they can locally give way axially under the pressure of the cylinder-head gasket, not only leading to an unequal distribution of the press-on force of the cylinder-head gasket, but also increasing the unequal deformation of the cylinder liner. Unequal shapes of running surfaces, i.e. cylinder shapes deviating in the range of a few $\mu$m from the circular shape and from the rectilinear generated shape, have an adverse effect on smooth piston running and on a good sealing action of the piston rings.

Where cylinder liners are cast in without incipient melting, retaining collars have already been formed externally on the end faces of the liners. The collars ensure an axial positive connection of the liner in the crankcase and prevent the liner from loosening axially. These collars can, however, usually be produced only by an additional machining operation, e.g. lathe-turning with cutting in the region between the collars, and by using more raw material.

Figure 10:
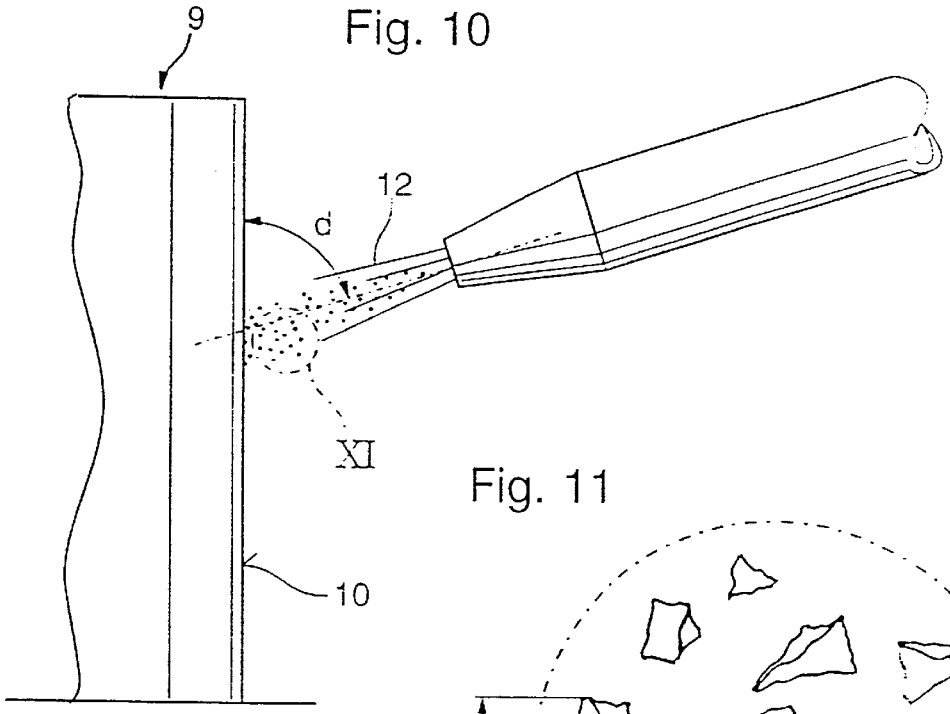
FIG. 10 is a view illustrating a method for blasting the outer surface of the liner blank with particles.
Figure 11:
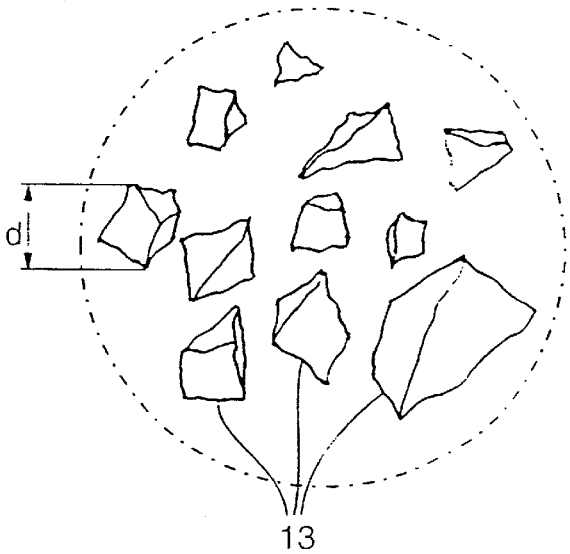
FIG. 11 is an enlarged detail of a few particles of hard material which are broken so as to have sharp edges and are used in the surface blasting according to the present invention.

So that the roughening according to the present invention can be produced on a cylinder-liner blank to be cast in, a tubular blank is first produced and machined to the desired shape and desired size. To roughen the outer surface 10 of the blank 9, which surface is to be surrounded by the material 16 of the light-metal crankcase 2, the surface 10 is blasted with particles 13 which are broken so as to have sharp edges. The particles 13 consist of a brittle hard material, preferably high-grade corundum, and are carried along by an air jet 12 directed by a nozzle 18 as seen in FIG. 10. The air-borne particle jet is directed onto the treatment location of the surface 10 of the blank 9 approximately transversely, that is to say at an angle $\alpha$ of about 90±45°. When they strike the blank 9, the particles roughen its surface 10 and thrust up the material in a pyramid-like or lancet-like manner to form material accumulations 11, or cause scabs of material to protrude and thereby form pointed or sharp-edged material elevations which merge at their base, over a wide area, into the basic material.

The particle-bearing air jet 12 must be optimized with regards its essential parameters, in particular with regard to the flow velocity of the particles or the velocity at which they strike the outer surface and to the particle density in the air stream. The desired surface topography of the roughened outer surface and optimum metallurgical bonding of the liner to the cast-round material are two of the main results of optimization. Parameter optimization of this type is within the skill of the ordinary person in the particle blasting field.

Figure 12:
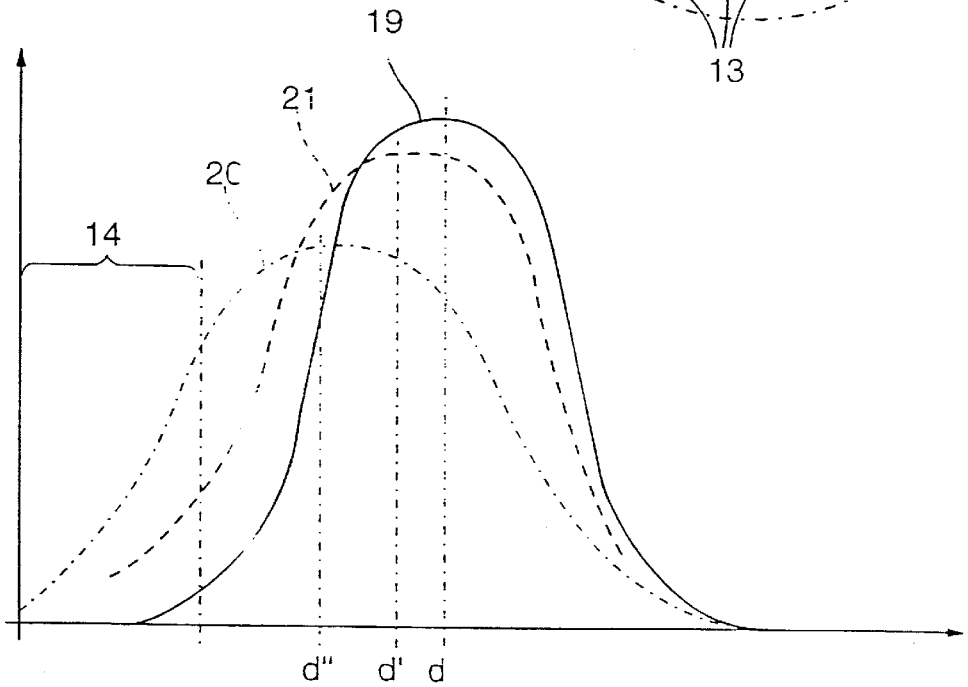
FIG. 12 is a graph with different frequency distributions of the size of the blasting particles in the new state, after use and after the blasting material has been treated.

The particles 13 of hard material which are employed have an average grain size d of about 70 $\mu$m. The average size essentially also determines the amount of roughness achieved. The average grain size should be greater than the sought-after roughness. With an average grain size of the blasting material of about 70 $\mu$m, and broken so as to have sharp edges, a roughness of about 30 to 60 $\mu$m can be achieved. The value given for the average grain size is a statistical average which, as the graph according to FIG. 12 illustrates, can be exceeded upwards and downwards in accordance with a bell-shaped frequency distribution 19.

Of course, the striking of the particles 13 on the outer surface 10 also causes force to be exerted on the particles, so that at least some of them are broken up. Consequently, during particle blasting, the grain size of the hard material particles employed is shifted in the direction of smaller average grain sizes (d"), as indicated in FIG. 12 by the frequency distribution 20 represented by a dot-and-dash line. By filtering off a fine fraction (the left-hand region 14 in the distribution graph of FIG. 12) out of the particle stream constantly or repeatedly, instance by instance and by feeding in a quantity of approximately equal mass, of a fresh particle mixture, a frequency distribution 21 around an average particle diameter d', which is only slightly smaller than the original average diameter d, can be achieved. By treating the particle mixture in this manner, an approximately constant particle size and therefore approximately constant surface roughness can be achieved.

In choosing and treating the blasting material, it is important that, not only the particle size but also, the particle shape is optimum and also remains optimum by suitable treatment measures. Splinter-like, lancet-like, tetrahedral, pyramid-like particles with pointed corners are preferred, whereas cubic or even globular particles are unfavorable for the sought after roughening. Insofar as the particles are broken up by striking the workpiece, it is better, under some circumstances, after being used several times, for the particles to break up completely and disintegrate into a fine fraction which can be separated out than for them merely to have their corners knocked off and to assume a pebble shape. Particles "rounded" in this manner would not afford the desired roughening effect, but, as seen under the microscope, would instead leave a relatively smooth hammered structure on the blasted surface. The desired breaking behavior can be observed, above all, in brittle materials.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Method for producing a light-metal which is to be cast into a casting, comprising the steps of machining a blank to a desired shape and desired size, blasting an outer surface of the blank, which outer surface is to be surrounded by the material of the casting, with a directed jet of hard material particles carried along in a flowing gas, the hard material particles comprising broken corundum with sharp edges and with predetermined grade and an average grain size of about 70 $\mu$m and roughening the blasted outer surface of the blank such that material of the blank near the outer surface acquires pyramid-shaped or lancet-shaped protruding scabs or accumulations.

2. Method according to claim 1, wherein the gas-borne particle jet is directed onto the treatment location of the surface of the blank at an angle of about 90±45°.

3. Method according to claim 1, wherein a fine fraction formed during the blasting from a break-up of the particles is continuously separated off from the particles, and new particles of similar mass of the hard material particles and having a specific average grain size are added to maintain the approximate average grain size of the blasting material.

4. The method according to claim 1, wherein the blank is a tubular blank for a cylinder liner to be cast into a light-metal crankcase of a reciprocating-piston engine.

* * * * *